US010987692B2

(12) United States Patent
Shi

(10) Patent No.: US 10,987,692 B2
(45) Date of Patent: Apr. 27, 2021

(54) CLEANING DEVICE

(71) Applicant: Wuhan China Star Optoelectronics Technology Co., Ltd., Hubei (CN)

(72) Inventor: Jie Shi, Guangdong (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 565 days.

(21) Appl. No.: 15/777,616

(22) PCT Filed: Jan. 15, 2018

(86) PCT No.: PCT/CN2018/072703
§ 371 (c)(1),
(2) Date: May 18, 2018

(87) PCT Pub. No.: WO2019/056669
PCT Pub. Date: Mar. 28, 2019

(65) Prior Publication Data

US 2020/0338581 A1 Oct. 29, 2020

(30) Foreign Application Priority Data

Sep. 25, 2017 (CN) ..... 201710872978.0

(51) Int. Cl.
*B05B 15/522* (2018.01)
*B08B 1/00* (2006.01)
*B08B 11/02* (2006.01)

(52) U.S. Cl.
CPC ..... *B05B 15/522* (2018.02); *B08B 1/006* (2013.01); *B08B 11/02* (2013.01)

(58) Field of Classification Search
CPC ..... B08B 1/005; B08B 9/027; B08B 9/021; B08B 9/02; B08B 11/02; B05B 15/555; B05B 15/522; B05B 1/044
(Continued)

(56) References Cited

U.S. PATENT DOCUMENTS 9,468,946 B2 * 10/2016 Inamasu ..... B08B 1/006
9,586,224 B2 * 3/2017 Chen ..... B05B 15/52
(Continued)

FOREIGN PATENT DOCUMENTS

CN 102161027 B * 8/2011 ..... B05C 15/02
CN 106622808 B * 5/2017 ..... B05B 15/02
(Continued)

OTHER PUBLICATIONS

Machine Translation of CN-107175886-A Description, Jan. 27, 2021, Espacenet, 4 pages (Year: 2021).*
(Continued)

*Primary Examiner* — Chee-Chong Lee
*Assistant Examiner* — Kevin Edward Schwartz
(74) *Attorney, Agent, or Firm* — Leong C. Lei

(57) ABSTRACT

Provided is a cleaning device, comprising a wiper, a first clamping plate, a second clamping plate, a first elastic clamp and a second elastic clamp. The first clamping plate comprises a first plate body, a first bent portion and a first end portion. The first bent portion extends between the first plate body and the first end portion in a bent manner. The second clamping plate comprises a second plate body, a second bent portion and a second end portion. The second bent portion extends between the second plate body and the second end portion in a bent manner. The wiper is positioned between the first clamping plate and the second clamping plate. The cleaning device is moved relative to the nozzle to wipe the
(Continued)

nozzle for cleaning. The wiper will not generate pollution and basically causes no wear to the nozzle.

20 Claims, 6 Drawing Sheets

(58) Field of Classification Search
USPC ..... 134/104.1, 166 R, 43, 24; 239/106
See application file for complete search history.

(56) References Cited

U.S. PATENT DOCUMENTS

| | | | | |
|---|---|---|---|---|
| 10,478,849 | B2 * | 11/2019 | Yuan | B08B 9/00 |
| 2017/0266698 | A1 * | 9/2017 | Yao | B08B 9/00 |

FOREIGN PATENT DOCUMENTS

| | | | | | |
|---|---|---|---|---|---|
| CN | 107175886 | A | * | 9/2017 | B41F 9/10 |
| JP | 2005270841 | A | * | 10/2005 | B05C 5/02 |

OTHER PUBLICATIONS

Machine Translation of CN-106622808-B Description, Jan. 27, 2021, Espacenet, 3 pages (Year: 2021).*
Machine Translation of CN-102161027-B Description, Jan. 27, 2021, Espacenet, 11 pages (Year: 2021).*
Machine Translation of JP-2005270841-A Description, Jan. 27, 2021, Espacenet, 4 pages (Year: 2021).*

* cited by examiner

CLEANING DEVICE

CROSS REFERENCE

This application claims the priority of Chinese Patent Application No. 201710872978.0, entitled "Cleaning device", filed on Sep. 25, 2017, the disclosure of which is incorporated herein by reference in its entirety.

FIELD OF THE INVENTION

The present application relates to a cleaning field, and more particularly to a cleaning device.

BACKGROUND OF THE INVENTION

In the liquid crystal display industry production line, there are equipments, having knife nozzle such as a clip clasp, a liquid knife or an air knife. The nozzles are widely used in the TFT-LCD (Thin Film Transistor-Liquid Crystal Display) panel manufacturing industry to act for spraying photoresist or a solution. FIG. 1 and FIG. 2 are structure diagrams of a liquid knife or an air knife according to prior art. As shown in FIG. 1, the clip clasp, the liquid knife or the air knife comprises a nozzle 20 and a nozzle tip 30. As shown in FIG. 2, the nozzle tip 30 has angles R1 and R2 with the nozzle 20 and forms a spout 301. In the TFT-LCD panel manufacturing process, after the clip clasp, the liquid knife or the air knife are used for some time, the nozzle will be clogged with impurities, to cause a spray bifurcation to result in poor process. Currently, for solving the spray bifurcation phenomenon of the spout of the liquid knife or the air knife, the operator holds a metal foil or a film flake to scrape off the plugging and impurities at the spout. However, with the metal foil for scraping, it is easy to cause friction to generate foreign object contamination or to wear nozzle structure. The film flake is easily bent and not easy to insert into the spout, which wastes more time and is low in efficiency. As moving for scraping, the film flake may be easy to be bent and frustrated, thus it needs to be kept straight with both hands all the time. The operation is very inconvenient.

SUMMARY OF THE INVENTION

An objective of the present application is to provide a cleaning device to solve the issue for cleaning the spout of the nozzle in prior art. The cleaning device does no pollution to the nozzle and the wear is small. The operation is easy and the efficiency is high.

For realizing the objective of the present application, the present application provides the following technical solutions:

First, the present application provides a cleaning device for cleaning a nozzle, wherein a nozzle tip is configured with a spout communicating with inside and outside of the nozzle, wherein the cleaning device comprises a wiper, a first clamping plate, a second clamping plate, a first elastic clamp and a second elastic clamp, the first clamping plate comprises a first plate body, a first bent portion and a first end portion, the first bent portion extends between the first plate body and the first end portion in a bent manner, the second clamping plate comprises a second plate body, a second bent portion and a second end portion, the second bent portion extends between the second plate body and the second end portion in a bent manner, the wiper is positioned between the first clamping plate and the second clamping plate, the wiper comprises a fixed portion and a cleaning portion, the first bent portion and the second bent portion are held in a relatively clamped state by a clamping force of the first elastic clamp, the fixed portion is clamped between the first bent portion and the second bent portion, the second elastic clamp is configured between the first end portion and the second end portion to keep the first plate body and the second plate body in an inside clamping state, the cleaning portion is positioned between the first plate body and the second plate body to insert it into the spout to clean the spout by clamping the nozzle tip with the first plate body and the second plate body and moving the cleaning device relative to the spout.

In the first possible embodiment, a bending direction of the first bent portion and a bending direction of the second bent portion are opposite to each other, a pair of first connecting buckles are provided on an edge of one side of the first bent portion facing the bending direction, a pair of second connecting buckles are provided on an edge of one side of the second bent portion facing the bending direction, the first elastic clamp are arranged in pairs and are respectively fixedly connected with the first connecting buckles and the second connecting buckles at both sides of the edges of the first bent portion and the second bent portion, an initial state of the first elastic clamp has a clamping force to the first bent portion and the second bent portion.

With combination of the aforesaid first possible embodiment, in the second possible embodiment, a pair of third connecting buckles are provided on an edge of one side of the first end portion away from the bending direction of the first bent portion, a pair of fourth connecting buckles are provided on an edge of one side of the second end portion away from the bending direction of the second bent portion, the second elastic clamp are arranged in pairs and are respectively fixedly connected with the third connecting buckles and the fourth connecting buckles at both sides of the edges of the first end portion and the second end portion, an initial state of the second elastic clamp has a tensile force to the first end portion and the second end portion, the first elastic clamp and the second elastic clamp grip the first clamping plate and the second clamping plate to form a gap between the first clamping plate and the second clamping plate, the gap receives the wiper.

With combination of the first possible embodiment, in the third possible embodiment, the first elastic clamp comprises a clamping end, two bent portions and two connecting ends, the clamping end, the two bent portions and the two connecting ends are sequentially connected and the bent portions and the connecting ends are at two sides of the clamping end.

With combination of the second possible embodiment, in the fourth possible embodiment, a thickness range of the wiper is from 0.08 mm to 0.12 mm and a width range of the gap is from 0.05 mm to 0.08 mm.

With combination of the first to fourth possible embodiments, in the fifth possible embodiment, a wiping sheet is arranged on the first clamping plate, the wiping sheet is positioned at a position on a surface of the first plate body fitting with the nozzle tip for wiping the nozzle tip.

With combination of the first to fifth possible embodiments, in the sixth possible embodiment, the cleaning device further comprises a plurality of the wipers arranged on the first clamping plate at equal intervals along the first plate body and perpendicular to the first end portion.

With combination of the first to fourth possible embodiments, in the seventh possible embodiment, the first clamping plate is provided with a guiding slot, the guiding slot is positioned at a transitional position of the first plate body to the first bent portion for guiding flowing-out fluid of cleaning the nozzle of a knife.

With combination of the first to fourth possible embodiments, in the eighth possible embodiment, the first clamping plate is provided with a hand-held portion, the hand-held portion is positioned on an outer surface of the first clamping plate to facilitate a hand-operated movement of the cleaning device.

With combination of the first to eighth possible embodiments, in the ninth possible embodiment, the hand-held portion is positioned on the outer surface of the first plate body to form a flat surface or an uneven shape and a surface of the hand-held portion has patterns.

The benefits of the present application are:

With arranging the first clamping plate and the second clamping plate and arranging the wiper between the first clamping plate and the second clamping plate, the first elastic clamp and the second elastic clamp are used to grip the wiper to wipe the nozzle for cleaning. The wiper will not generate pollution and basically causes no wear to the nozzle. It does not need to pull the wiper straight with hands. The operation is simple and the efficiency is high.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present application are described in detail with the technical matters, structural features, achieved objects, and effects with reference to the accompanying drawings as follows. It is clear that the described embodiments are part of embodiments of the present application, but not all embodiments. Based on the embodiments of the present application, all other embodiments, which can be obtained by those of ordinary skill in the art without paying creative efforts, should all be considered within the scope of protection of the present application.

Figure 1:
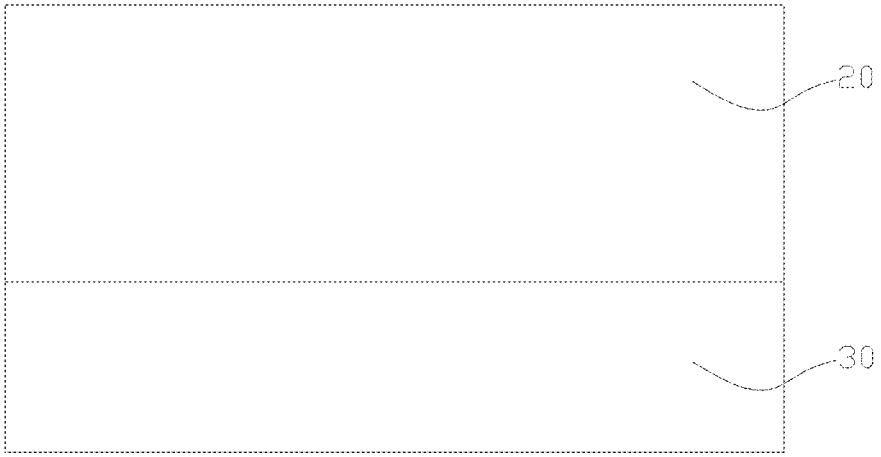
FIG. 1 is a structure diagram of a nozzle according to prior art.
Figure 2:
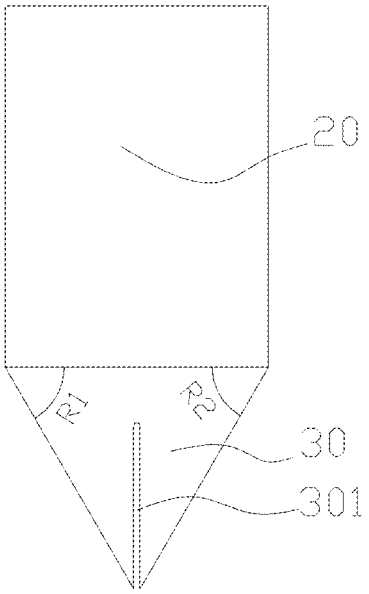
FIG. 2 is a lateral structure diagram of the nozzle in FIG. 1.

Please refer to FIG. 1 and FIG. 2. The objective of the cleaning device of the present application is to clean the spout 301. The spout 301 is positioned at a nozzle tip 30. The spout 301 extends along one direction of the nozzle tip. The proper material is sprayed out from the inside of the spout 301 to achieve the spray coating function. The nozzle tip 30 is connected to the nozzle 20. The nozzle tip 30 forms an inverted conical structure with the spout 301 having a downward opening.

Please refer from FIG. 3 to FIG. 6. The wiper 40 is omitted in FIG. 3. The skill of the present application is to insert the wiper 40 into the spout 301 for cleaning. One preferred embodiment of the present application provides a cleaning device 10. The cleaning device 10 comprises a wiper 40, a first clamping plate 101, a second clamping plate 111, a first elastic clamp 104 and a second elastic clamp 105. The first clamping plate 101 comprises a first plate body 108, a first bent portion 106 and a first end portion 107. The first bent portion 106 extends between the first plate body 108 and the first end portion 107 in a bent manner. The second clamping plate 111 comprises a second plate body 119, a second bent portion 117 and a second end portion 118. The second bent portion 117 extends between the second plate body 119 and the second end portion 118 in a bent manner. The wiper 40 is positioned between the first clamping plate 101 and the second clamping plate 111. The wiper 40 comprises a fixed portion 41 and a cleaning portion 42. The first bent portion 106 and the second bent portion 117 are held in a relatively clamped state by a clamping force of the first elastic clamp 104. The fixed portion 41 is clamped between the first bent portion 106 and the second bent portion 117. The second elastic clamp 105 is configured between the first end portion 107 and the second end portion 118 to keep the first plate body 108 and the second plate body 119 in an inside clamping state. The cleaning portion 42 is positioned between the first plate body 108 and the second plate body 119 to insert into the spout 301 to clean the spout 301 by clamping the nozzle tip 30 with the first plate body 108 and the second plate body 119 and moving the cleaning device 10 relative to the spout 301.

In this embodiment, the shape of the first plate body 108 of the first clamping plate 101 is rectangular. It may also be circular or prismatic. The first end portion 107 and the second end portion 118 are pressed to fit the first plate body 108 and the second plate body 119 with the nozzle tip 30 for clamping. As cleaning is accomplished and the cleaning device needs to be removed, first end portion 107 and the second end portion 118 are pressed again for opening the first clamping plate 101 and the second clamping plate 111.

In this embodiment, a material of the first clamping plate 101 can be stainless steel or wear-resistant plastic. In general, both metal material and plastic can be the material of the first clamping plate 101. After testing, stainless steel or wear-resistant plastic with good strength, stiffness, wear resistance and reliability is the preferred material.

The second clamping plate 111 can have a similar structure with the first clamping plate 101. The second clamping plate 111 comprises a second plate body 119 and a second bent portion 117 bent along the second side of the second plate body 119. The second bent portion 117 is arranged corresponding to the first bent portion 106 and a bending direction of the first bent portion 106 and a bending direction of the second bent portion 117 are opposite to each other such that the first clamping plate 101 and the second clamping plate 111 as clamping form an axisymmetric structure shape. The first clamping plate 107 and the second clamping plate 111 according to this embodiment can be made in the same structure but only the first bent portion and the second bent portion are opposite to each other for universal installation.

In one embodiment, referring from FIG. 3 to FIG. 6, the bending direction of the first bent portion 106 and the bending direction of the second bent portion 117 are opposite to each other. A pair of first connecting buckles 109 are provided on an edge of one side of the first bent portion 106 facing the bending direction thereof (because the position of the first connecting buckle in the drawing is blocked, the first connecting buckle of the first clamping plate 101 is represented by the reference number 109 of the second clamping plate in the figure and the positions, the shapes and the structures of the two are similar). A pair of second connecting buckles 122 is provided on an edge of one side of the second bent portion 117 facing the bending direction thereof. The first elastic clamp 104 are arranged in pairs and are respectively fixedly connected with the first connecting buckles 109 and the second connecting buckles 122 at both sides of the edges of the first bent portion 106 and the second bent portion 107. An initial state of the first elastic clamp 104 has a clamping force to the first bent portion 106 and the second bent portion 117.

In this embodiment, the first elastic clamp 104 is arranged in pairs. For convenience, the first elastic clamp at one side is identified by the numeral 104 and the first elastic clamp at the other side is identified by the numeral 114. The two are exactly the same. The first connecting buckle 109 and the second connecting buckle 122 may adopt a buckle structure and may also be in a form of a zipper lock or a screw. The specific structure is not limited in the present invention. The first elastic clamp 104 maintains a clamping state, which is equivalent to forming a pivot. With the pivot, the first clamping plate 101 and the second clamping plate 111 can rotate.

In one embodiment, referring from FIG. 3 to FIG. 6, a pair of third connecting buckles is provided on an edge of one side of the first end portion 107 away from the bending direction of the first bent portion 106. A pair of fourth connecting buckles is provided on an edge of one side of the second end portion 118 away from the bending direction of the second bent portion 117. The second elastic clamp 105 are arranged in pairs and are respectively fixedly connected with the third connecting buckles and the fourth connecting buckles at both sides of the edges of the first end portion 107 and the second end portion 118. An initial state of the second elastic clamp 105 has a tensile force to the first end portion 107 and the second end portion 118. The first elastic clamp 104 and the second elastic clamp 105 grip the first clamping plate 101 and the second clamping plate 111 to form a gap 121 between the first clamping plate 101 and the second clamping plate 111. The gap 121 receives the wiper 40.

In this embodiment, referring to the description of the first connecting buckle 109 and the second connecting buckle 122. The shapes, structures and positions of the third connecting buckles and the fourth connecting buckles may be the same. The second elastic clamp 105 further comprises a second elastic clamp labeled 115 on the other side. Both of which are the same except that different numbers are used for convenience of description. The second elastic clamp 105 is pulled outwardly to clamp the first clamping plate 101 and the second clamping plate 111 with the first elastic clamp 104 as a pivot. The first plate body 108 and the second plate body 119 assume a tendency of fitting so as to clamp the inverted conical surface of the nozzle tip 30.

In this embodiment, the wiper 40 may adopt the film sheet in prior art and may also adopt other non-metal materials, such as a plastic sheet or a paper base sheet. A thickness range of the wiper 40 may be from 0.08 mm to 0.12 mm. The preferred thickness is 0.08 mm, 0.1 mm or 0.12 mm.

In this embodiment, corresponding to the wiper 40, a width range of the gap 121 is from 0.05 mm to 0.08 mm. Since the thickness of the wiper 40 is from 0.08 mm to 0.12 mm, the range of the gap 121 needs to be configured. With experiments, the thickness of the gap 121 is preferably about 0.03 mm, which is smaller than the thickness of the wiper 40. It allows the wiper 40 to pass through without cutting or tearing the wiper 40. As an illustration, as the thickness of the wiper 40 is 0.08 mm, the preferable thickness of the gap is 0.05 mm; as the thickness of the wiper 40 is 0.1 mm, the preferable thickness of the gap is 0.07 mm; as the thickness of the wiper 40 is 0.12 mm, the preferable thickness of the gap is 0.08 mm.

Figure 3:
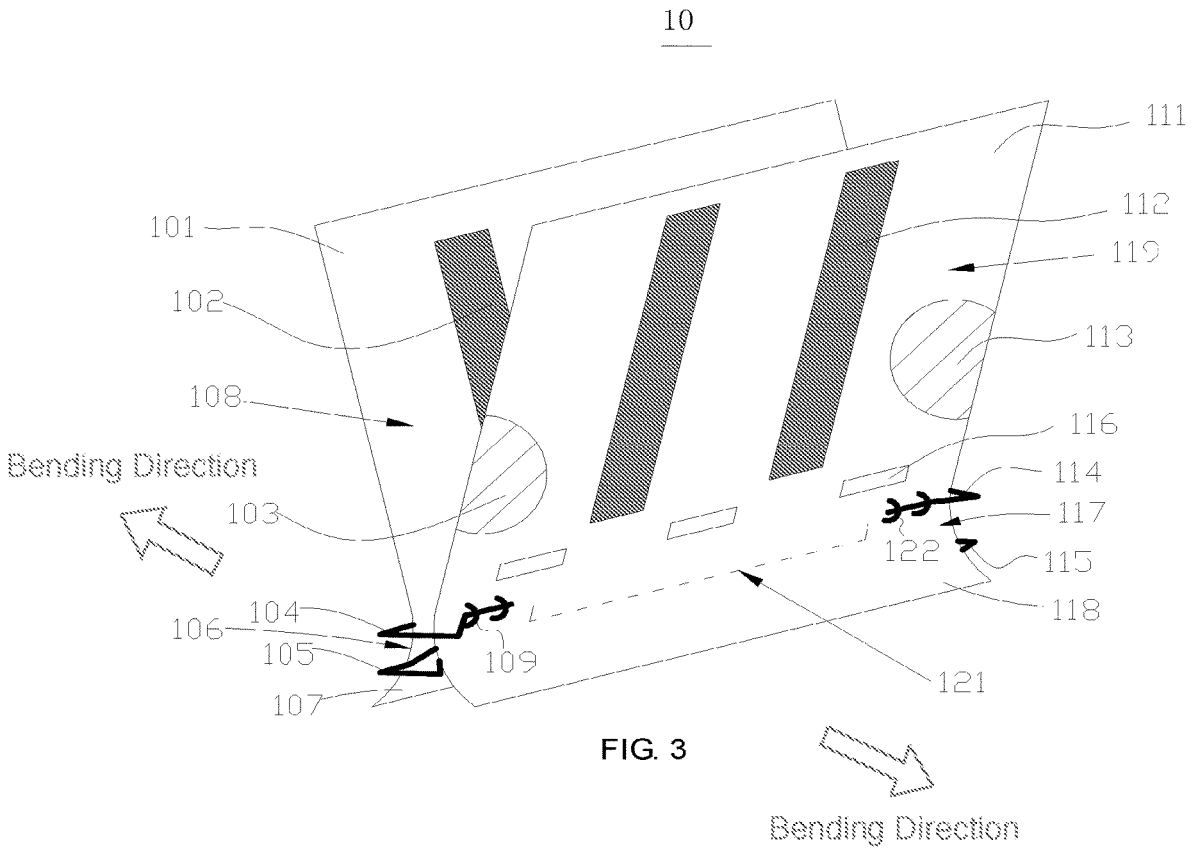
FIG. 3 is a structure diagram of a cleaning device according to the embodiment of the present application, in which a wiper is omitted.
Figure 4:
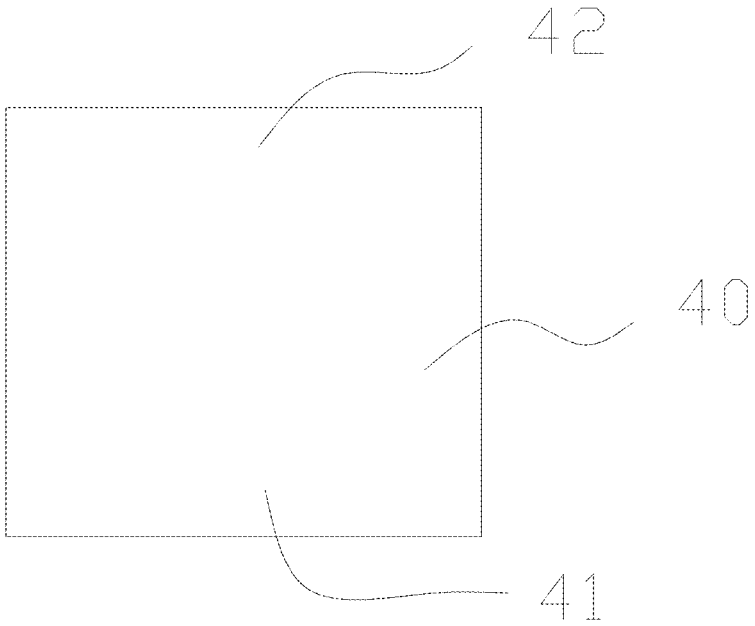
FIG. 4 is a structure diagram of a wiper according to one embodiment of the present application.
Figure 7:
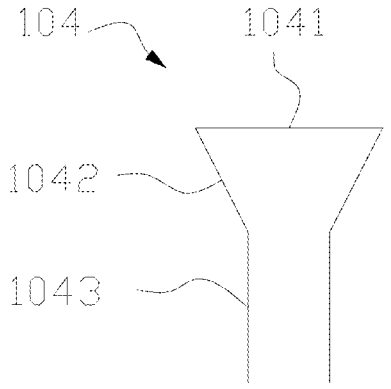
FIG. 7 is a structure diagram of a first elastic clamp.

In one embodiment, referring to FIG. 3 and FIG. 7, the first elastic clamp 104 comprises a clamping end 1041, two bent portions 1042 and two connecting ends 1043. The clamping end 1041, the two bent portions 1042 and the two connecting ends 1043 are sequentially connected and the bent portions 1042 and the connecting ends 1043 are at two sides of the clamping end 1041.

Please refer to FIG. 7, which shows the first embodiment of the first elastic clamp 104. Specifically, the first elastic clamp 104 is taken for an illustration and other elastic clamps may be referred thereto. The first elastic clamp 104 comprises a clamping end 1041, two bent portions 1042 and two connecting ends 1043. The clamping end 1041 is connected between the bent portions 1042 arranged in pairs. The connecting ends 1043 are arranged in pairs and connected to the bent portions 1042. The bent portions 1042 form a structure bent from two ends of the clamping end 1041 toward the middle of the clamping end. The connecting ends 1043 are fixed with the first connecting buckles 109. Due to the bending of the bent portions, the first elastic clamp 104 has greater elasticity and the force-bearing ability of the elastic clamp is strengthened so that the clamping for the first clamping plate 101 and the second clamping plate 111 is more stable. Furthermore, the other end of the connecting end 1043 connected with the bent portion 1042 also has a certain flexibility and can be bent to further clamp the first connecting buckles 109 to make the connection more stable.

Figure 6:
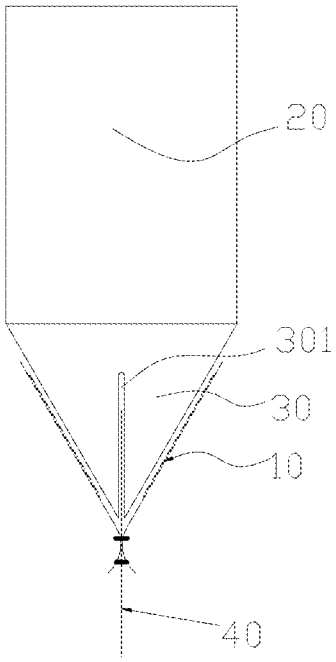
FIG. 6 is lateral view diagram of a usage state of the cleaning device in FIG. 5.
Figure 8:
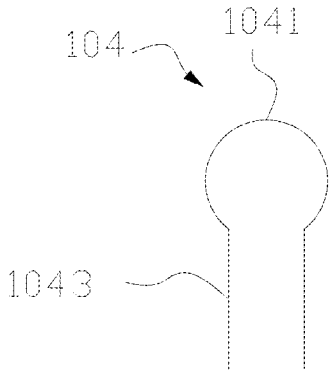
FIG. 8 is a structure diagram of another first elastic clamp.

Please refer to FIG. 8, which shows another embodiment of the first elastic clamp 104, which is substantially the same as the embodiment shown in FIG. 6, except that the connecting end 1041 is bent in an arc shape or a sector shape.

Figure 9:
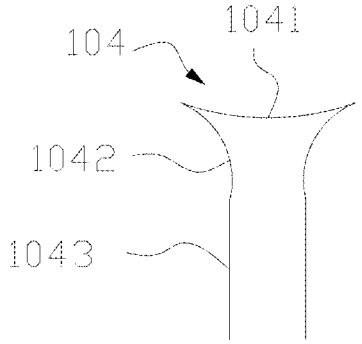
FIG. 9 is a structure diagram of one another first elastic clamp.

Please refer to FIG. 9, which shows another embodiment of the first elastic clamp 104, which is substantially the same as the embodiment shown in FIG. 6, except that the connecting end 1041 is an inwardly bent arc and the bent portion 1042 is an inwardly bent arc so as to make the first elastic clamp 104 more elastic.

Figure 5:
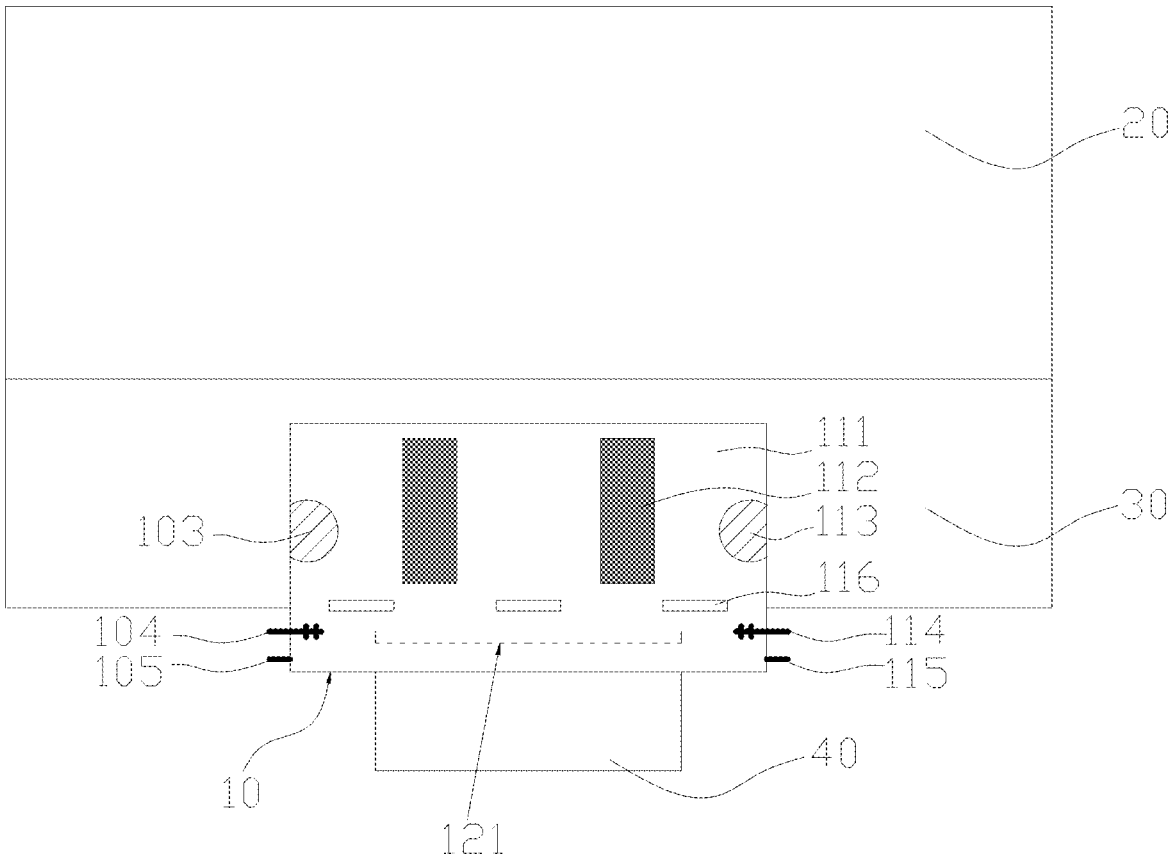
FIG. 5 is a diagram of a usage state of the cleaning device according to one embodiment.

In one embodiment, referring to FIG. 3 and FIG. 5, a wiping sheet 102 is arranged on the first clamping plate 101. The wiping sheet 102 is positioned at a position on a surface of the first plate body 101 fitting with the nozzle tip 30 for wiping the nozzle tip 30. Furthermore, a plurality of wiping sheets 102 are arranged on the first clamping plate 101 at equal intervals along the first plate body 108 and perpendicular to the first end portion 107.

In this embodiment, the function of the wiping sheet 102 is to wipe off the foreign objects such as liquid on the nozzle tip 30 so that the nozzle can be more completely cleaned. The wiping sheet 102 is detachably arranged to facilitate timely replacement. The material of the wiping sheet 102 may be soft rubber, cotton material or the like. The wiping sheets 102 are arranged at intervals, which save the amount of wiping sheets and is also easy to replace. It can be understood that the wiping sheets 112 are also configured on the second clamping plate 111. The structure and the arrangement can be referred to the wiping sheets 102 on the first clamping plate 101.

In one embodiment, referring to FIG. 3 and FIG. 5, since the first clamping plate 101 is blocked by the second clamping plate 111. For convenience, the numbers of the second plate 111 are used for description. The first clamping plate 101 is provided with a guiding slot 116. The guiding slot 116 is positioned at a transitional position of the first plate body 108 to the first bent portion 106 for guiding flowing-out fluid of cleaning the nozzle of a knife.

In this embodiment, the second clamping plate 111 can also be provided with a guiding slot 116. The guiding slot 116 can be an opening slot penetrating the first clamping plate 101 and the second clamping plate 111. Then, a plurality of guiding slot 116 can be configured at intervals to reduce the cutting to the first clamping plate 101 and the second clamping plate 111 to preserve the proper strength. Alternatively, the guiding slot 116 can be a groove not penetrating the plate but arranged at the inner surface of the first clamping plate 101 to form an invisible structure.

In one embodiment, referring to FIG. 3 and FIG. 5, the first clamping plate is provided with a hand-held portion 103. The hand-held portion 103 is positioned on an outer surface of the first clamping plate 101 to facilitate a hand-operated movement of the cleaning device 10. Furthermore, the hand-held portion 103 is positioned on the outer surface of the first plate body 108 to form a flat surface or an uneven shape and a surface of the hand-held portion has patterns.

In this embodiment, the hand-held portion 103 is configured on the outer surface of the first clamping plate 101 and a plurality of hand-held portions can be arranged. For instance, another hand-held portion 113 is arranged for facilitating two-hands operation. The shape can be circular. The patterns facilitate the hand pressing of the operator to reciprocate on the nozzle tip of the knife for cleaning.

Above are embodiments of the present application, which does not limit the scope of the present application. Any modifications, equivalent replacements or improvements within the spirit and principles of the embodiment described above should be covered by the protected scope of the invention.

What is claimed is:

1. A cleaning device for cleaning a nozzle, wherein a nozzle tip is configured with a spout communicating with inside and outside of the nozzle, wherein the cleaning device comprises a wiper, a first clamping plate, a second clamping plate, a first elastic clamp and a second elastic clamp, the first clamping plate comprises a first plate body, a first bent portion and a first end portion, the first bent portion extends between the first plate body and the first end portion in a bent manner, the second clamping plate comprises a second plate body, a second bent portion and a second end portion, the second bent portion extends between the second plate body and the second end portion in a bent manner, the wiper is positioned between the first clamping plate and the second clamping plate, the wiper comprises a fixed portion and a cleaning portion, the first bent portion and the second bent portion are held in a relatively clamped state by a clamping force of the first elastic clamp, the fixed portion of the wiper is clamped between the first bent portion and the second bent portion, the second elastic clamp is arranged between the first end portion and the second end portion to keep the first plate body and the second plate body in an inside clamping state, the cleaning portion is positioned between the first plate body and the second plate body to insert into the spout to clean the spout by clamping the nozzle with the first plate body and the second plate body and moving the cleaning device relative to the spout, wherein the second elastic clamp is arranged between the first end portion of the first clamping plate and the second end portion of the second clamping plate to provide a tensile force to bias the first clamping plate and the second end portion of the second clamping plate outward so as to have the first plate body of the first clamping plate and the second plate body of the second clamping plate clamp the nozzle tip of the nozzle.

2. The cleaning device according to claim 1, further comprising an additional first elastic clamp to pair with the first elastic clamp, wherein a bending direction of the first bent portion and a bending direction of the second bent portion are opposite to each other, a pair of first connecting buckles are provided on an edge of one side of the first bent portion facing the bending direction of the first bent portion, a pair of second connecting buckles are provided on an edge of one side of the second bent portion facing the bending direction of the second bent portion, the first elastic clamp are arranged in pairs and are respectively fixedly connected with the first connecting buckles and the second connecting buckles at both sides of the edges of the first bent portion and the second bent portion, an initial state of the first elastic clamp has a clamping force to the first bent portion and the second bent portion.

3. The cleaning device according to claim 2, wherein the second elastic clamp is fixedly connected with the edges of the first end portion and the second end portion, the second elastic clamp applies the tensile force to the first end portion and the second end portion in an initial state, the first elastic clamp and the second elastic clamp grip the first clamping plate and the second clamping plate to form a gap between the first clamping plate and the second clamping plate, the gap receives the wiper.

4. The cleaning device according to claim 3, wherein a thickness range of the wiper is from 0.08 mm to 0.12 mm and a width range of the gap is from 0.05 mm to 0.08 mm.

5. The cleaning device according to claim 4, wherein a wiping sheet is arranged on the first clamping plate, the wiping sheet is positioned at a position on a surface of the first plate body fitting with the nozzle tip for wiping the nozzle tip.

6. The cleaning device according to claim 4, wherein the first clamping plate is provided with a guiding slot, the guiding slot is positioned at a transitional position of the first plate body to the first bent portion for guiding flowing-out fluid of cleaning the nozzle of a knife.

7. The cleaning device according to claim 3, wherein a wiping sheet is arranged on the first clamping plate, the wiping sheet is positioned at a position on a surface of the first plate body fitting with the nozzle tip for wiping the nozzle tip.

8. The cleaning device according to claim 3, wherein the first clamping plate is provided with a guiding slot, the guiding slot is positioned at a transitional position of the first plate body to the first bent portion for guiding flowing-out fluid of cleaning the nozzle of a knife.

9. The cleaning device according to claim 3, wherein the first clamping plate is provided with a hand-held portion, the hand-held portion is positioned on an outer surface of the first clamping plate to facilitate a hand-operated movement of the cleaning device.

10. The cleaning device according to claim 2, wherein the first elastic clamp comprises a clamping end, two bent portions and two connecting ends, the clamping end, the two bent portions and the two connecting ends are sequentially connected and the bent portions and the connecting ends are at two sides of the clamping end.

11. The cleaning device according to claim 10, wherein a wiping sheet is arranged on the first clamping plate, the wiping sheet is positioned at a position on a surface of the first plate body fitting with the nozzle tip for wiping the nozzle tip.

12. The cleaning device according to claim 10, wherein the first clamping plate is provided with a guiding slot, the guiding slot is positioned at a transitional position of the first plate body to the first bent portion for guiding flowing-out fluid of cleaning the nozzle of a knife.

13. The cleaning device according to claim 2, wherein a wiping sheet is arranged on the first clamping plate, the wiping sheet is positioned at a position on a surface of the first plate body fitting with the nozzle tip for wiping the nozzle tip.

14. The cleaning device according to claim 2, wherein the first clamping plate is provided with a guiding slot, the guiding slot is positioned at a transitional position of the first plate body to the first bent portion for guiding flowing-out fluid of cleaning the nozzle of a knife.

15. The cleaning device according to claim 2, wherein the first clamping plate is provided with a hand-held portion, the hand-held portion is positioned on an outer surface of the first clamping plate to facilitate a hand-operated movement of the cleaning device.

16. The cleaning device according to claim 1, wherein at least one wiping sheet is arranged on the first clamping plate, the at least one wiping sheet is positioned at a position on a surface of the first plate body fitting with the nozzle tip for wiping the nozzle tip.

17. The cleaning device according to claim 16, wherein the at least one wiping sheet comprises a plurality of wiping sheets arranged on the first clamping plate at equal intervals along the first plate body and perpendicular to the first end portion.

18. The cleaning device according to claim 1, wherein the first clamping plate is provided with a guiding slot, the guiding slot is positioned at a transitional position of the first plate body to the first bent portion for guiding flowing-out fluid of cleaning the nozzle of a knife.

19. The cleaning device according to claim 1, wherein the first clamping plate is provided with a hand-held portion, the hand-held portion is positioned on an outer surface of the first clamping plate to facilitate a hand-operated movement of the cleaning device.

20. The cleaning device according to claim 19, wherein the hand-held portion is positioned on the outer surface of the first plate body to form a flat surface or an irregular surface, and a surface of the hand-held portion has patterns.

* * * * *